US006959924B2

(12) United States Patent
Couturier

(10) Patent No.: US 6,959,924 B2
(45) Date of Patent: Nov. 1, 2005

(54) EUCHRE SCOREKEEPER

(76) Inventor: Julie Couturier, 19500 Rock St., Roseville, MI (US) 48066

( * ) Notice: Subject to any disclaimer, the term of this patent is extended or adjusted under 35 U.S.C. 154(b) by 298 days.

(21) Appl. No.: 10/034,527

(22) Filed: Dec. 28, 2001

(65) Prior Publication Data

US 2002/0084585 A1 Jul. 4, 2002

Related U.S. Application Data

(60) Provisional application No. 60/259,519, filed on Jan. 3, 2001.

(51) Int. Cl.[7] ..... A63B 71/00

(52) U.S. Cl. ..... 273/148

(58) Field of Search ..... 273/148 R, 148 A; 116/325; 235/90

(56) References Cited

U.S. PATENT DOCUMENTS

| | | | | | |
|---|---|---|---|---|---|
| 286,583 | A | * | 10/1883 | Boteler | 235/90 |
| 592,081 | A | * | 10/1897 | Crocker | 235/90 |
| 839,253 | A | * | 12/1906 | Armstrong | 273/148 A |
| 1,714,929 | A | * | 5/1929 | Smith | 273/148 A |
| D91,962 | S | * | 4/1934 | Pawliger | 116/325 |
| 2,113,369 | A | * | 4/1938 | Bochicchio | 116/225 |
| 2,153,453 | A | * | 4/1939 | Bucklin | 100/265 |
| 2,288,671 | A | * | 7/1942 | Batchelder | 217/57 |
| 2,482,247 | A | * | 9/1949 | Colon | 235/90 |
| 2,544,900 | A | * | 3/1951 | Saqui | 235/90 |
| D164,148 | S | * | 8/1951 | Alford | 235/90 |
| 2,770,209 | A | * | 11/1956 | Niclaus | 116/325 |
| 3,520,536 | A | * | 7/1970 | Kindelan | 235/90 |
| 3,576,174 | A | * | 4/1971 | Topel et al. | 116/222 |
| 3,702,703 | A | * | 11/1972 | DuBois | 206/315.1 |
| 3,999,504 | A | * | 12/1976 | Kearse | 116/200 |
| 4,195,767 | A | * | 4/1980 | Harden | 235/90 |
| 4,332,386 | A | * | 6/1982 | Townsend | 235/90 |
| 4,368,516 | A | * | 1/1983 | Morin | 273/148 R |
| 4,520,749 | A | * | 6/1985 | Jefferson | 116/324 |
| 4,673,915 | A | * | 6/1987 | Cobb | 116/325 |
| 4,805,909 | A | * | 2/1989 | Roland | 116/325 |
| 5,491,324 | A | * | 2/1996 | Vanderpool | 116/325 |
| 5,952,637 | A | * | 9/1999 | Strunk | 16/225 |
| 5,979,752 | A | * | 11/1999 | Holloway | 116/325 |
| 6,311,976 | B1 | * | 11/2001 | Yoseloff et al. | 273/138.2 |

FOREIGN PATENT DOCUMENTS

| | | | | |
|---|---|---|---|---|
| WO | WO 90/10480 | * | 9/1990 | A63F/1/04 |

* cited by examiner

*Primary Examiner*—Derris H. Banks
*Assistant Examiner*—Dolores R Collins
(74) *Attorney, Agent, or Firm*—Carlson, Gaskey & Olds

(57) ABSTRACT

A unique Euchre scoring device includes a tablet with aligned rows of scoring spots to keep score of each of the two steams in the card game Euchre. Further, the device includes a storage compartment, and an indication of what suit is trump. The device also allows an easy identification of which the two teams named the trump suit.

1 Claim, 2 Drawing Sheets

EUCHRE SCOREKEEPER

This application claims priority to Provisional Application Ser. No. 60/259,519 filed Jan. 3, 2001.

BACKGROUND OF THE INVENTION

This application relates to a method of assisting a player of the card game Euchre with keeping track of aspects of the game.

Euchre is a popular game that requires score to be kept over a serial of hands. Also, within any one hand there is a card suit that is called the "trump" suit for the particular hand In the past, Euchre players have typically made some form of improvised scorekeeping device. As an example, unused cards may have been utilized to keep score.

It would be desirable to have a scorekeeping device that allows for the keeping of score, and also for identifying what suit may be trump in any particular hand.

SUMMARY OF THE INVENTION

In general, the present invention relates to a device that assists in keeping score of a Euchre game. The device includes a tablet with two types of spots and markers. The first type keeps track of the score of the two different "teams." As an example, there are typically ten of this type of spots aligned on each side of the tablet. Pins or other markers can be inserted into the spots and moved as the score changes.

Further, there are preferably four markers for identifying that what suit is trump, and which will also identify which of the two teams named the trump.

Also, the tablet has a slideable cover which can be moved to expose a storage space for the cards and the market pegs.

In summary, the present invention provides a unique and simple method for keeping track of various aspects of the card game Euchre.

These and other features of the present invention may be best understood from the following specification and drawings, the following of which is a brief description.

DETAILED DESCRIPTION OF THE PREFERRED EMBODIMENT

Figure 1:
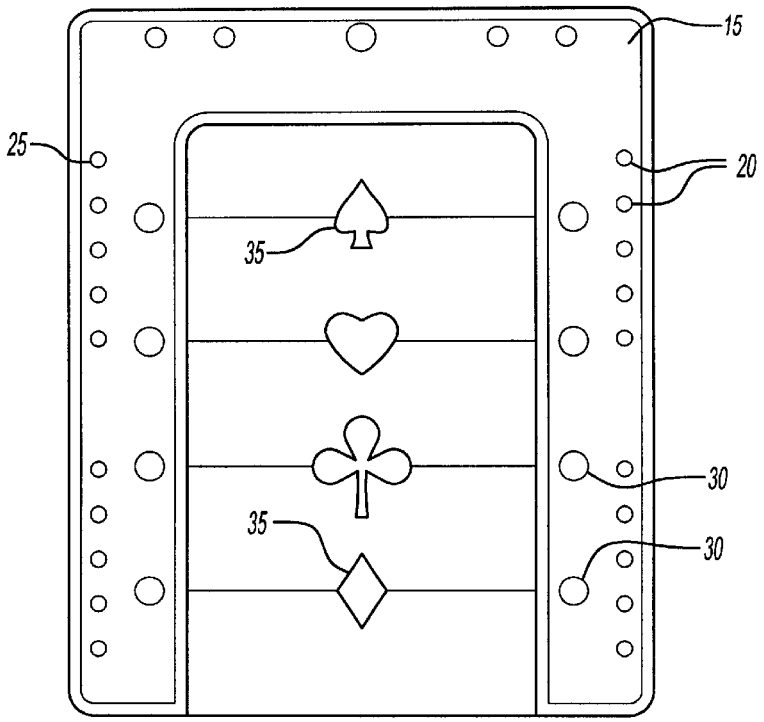
FIG. 1 is a top view of the inventive Euchre device.

The present invention relates generally to a device and method for keeping score of the popular card game known as Euchre. As shown in FIG. 1, the device comprises a tablet (15) with two types of spots. The first type of spot (20) tracks the number of points each team has. The second type of spot (30) tracks the so-called "trump" suit, whether a spade, heart, club or diamond. There are also spots (30) for each team, such that the device identifies the team that named trump.

Ten spots (20) of the first type (the point hole) are aligned on one side of the tablet with another ten spots (25) of the first type aligned on the other side. Each side thus has ten spots each to track the number of points. Markers for these spots may be colored differently for each team. More or less spots of the first type may be provided to alter the number of points tracked. As a team wins a hand, the team places a marker on the spot, advancing the marker for each additional win.

Four spots (30) of the second type (the trump suit spot) are aligned next to the four different suit symbols (35), heart, spade, club or diamond and on both sides. During the course of a game, when a suit is selected or drawn, a team tracks the suit for the hand by placing a marker by the spot nearest the appropriate suit symbol. The spots of the second type also identify which team named trump.

Figure 2:
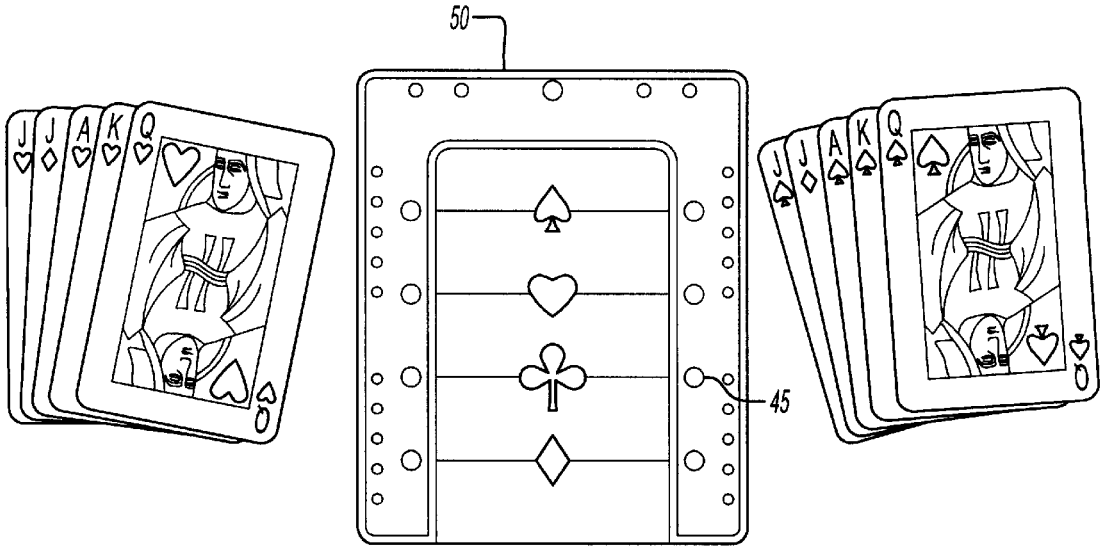
FIG. 2 is a top view of the device.
Figure 3:
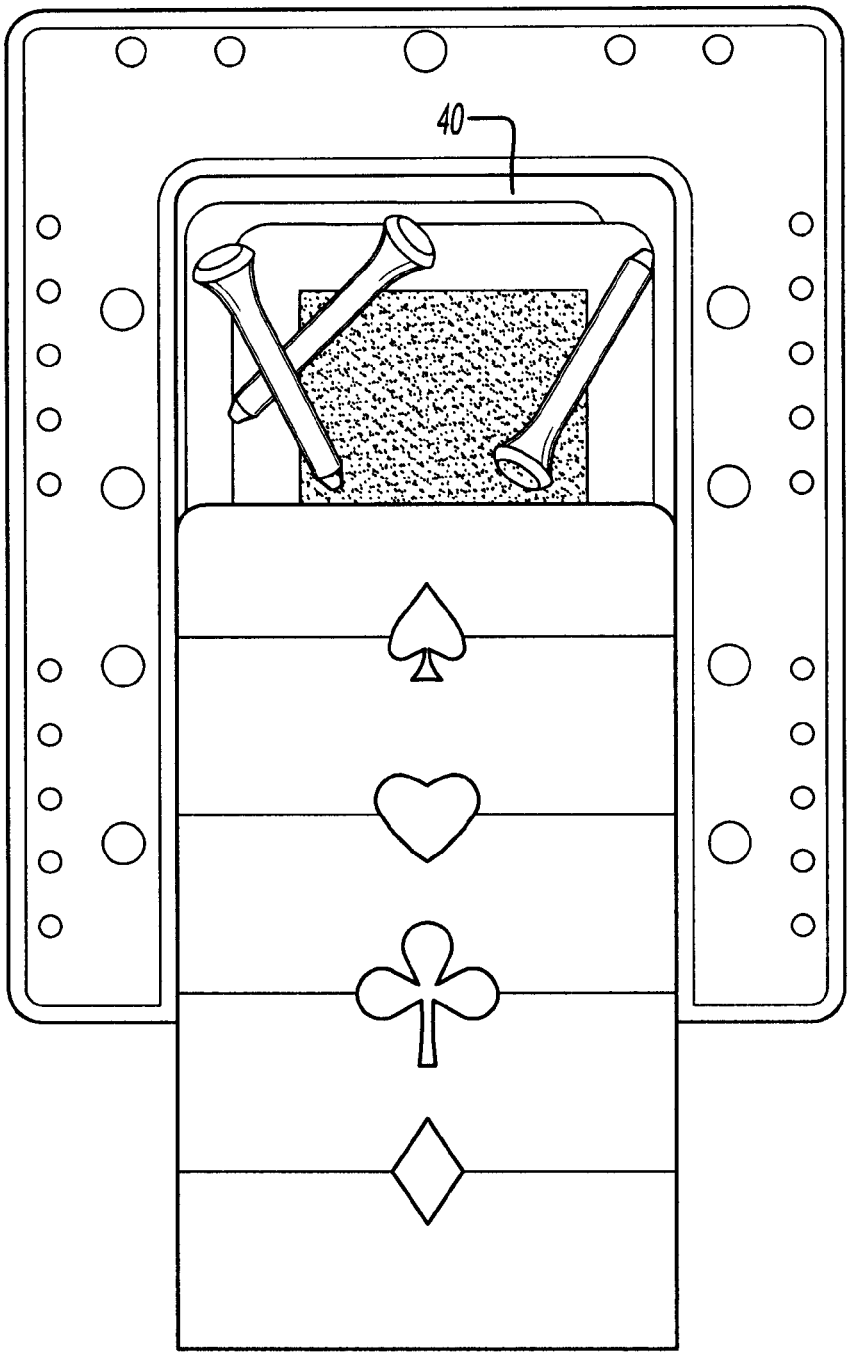
FIG. 3 shows the device open to expose the storage compartment.

The tablet (15) is formed to store a set of Euchre cards along with markers to be placed on the two types of spots. As shown by FIG. 3, a cover embossed with the four suits (35) slides over the opening of the storage space (40) for the cards and pegs. This cover aligns the four suits with each of the spots that track the suit. Additional spots may serve to store markers. Moreover, as shown FIGS. 2 and 3, the spots may comprise holes (20) while the markers comprise pegs (45 and 50). Points and trump suit are tracked by inserting the peg in the appropriate hole.

A work of ordinary skill in this art would recognize that certain modifications will come within the scope of this invention. For that reason the following claims should be studied to determine the true scope and content of this invention.

I claim:

1. A scoring device for Euchre comprising:

a generally flat tablet surface comprising:

a marker surface including two sets of scorekeeping spots with there being at least ten spots for each of said two sets, and marker pegs to be inserted into said scorekeeping spots;

an indicia of the four types of card suits, with trump identification spots associated with each of said suits, and for identifying which of said teams named one of said suits as trump;

a portion of said devices is slideable to expose a storage compartment within said tablet;

said portion of said device is the portion of said device including the indicia for identifying said card suits;

each of said sets of scoring spots are aligned along each of two sides of said tablet; and said spots for identifying trump are positioned in rows on each side of said indicia and inwardly of said first set of scoring spots, with said sets of scoring spots and spots for identifying trump being aligned on each side of said portion of said device which is removable such that each of two teams playing euchre has a set of scoring spots, and the side which includes the identification for trump will also provide said identification of which team named a suit as trump.

* * * * *